US009333760B2

(12) United States Patent
Lu et al.

(10) Patent No.: US 9,333,760 B2
(45) Date of Patent: May 10, 2016

(54) METHOD AND APPARATUS FOR DELIVERING SOLID-INK PELLETS

(71) Applicant: XEROX CORPORATION, Norwalk, CT (US)

(72) Inventors: Michael Q Lu, Fairport, NY (US); Robert B Anderson, Syracuse, NY (US); John R Uchal, Webster, NY (US); D. Clay Johnson, Rochester, NY (US); Eliud Robles Flores, Webster, NY (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 14/246,044

(22) Filed: Apr. 5, 2014

(65) Prior Publication Data

US 2015/0283818 A1 Oct. 8, 2015

(51) Int. Cl.
*B41J 2/175* (2006.01)
*B41J 2/17* (2006.01)

(52) U.S. Cl.
CPC ..... *B41J 2/17593* (2013.01); *B41J 2/175* (2013.01)

(58) Field of Classification Search
CPC ..... B41J 2/17593; B41J 2/175; B41J 2002/17516; B41J 2/225
USPC ..... 347/84–86, 88
See application file for complete search history.

(56) References Cited

U.S. PATENT DOCUMENTS 8,474,961 B2 * 7/2013 Enderle et al. ..... 347/88

* cited by examiner

*Primary Examiner* — An Do
(74) *Attorney, Agent, or Firm* — Joseph E. E. Root

(57) ABSTRACT

The present disclosure provides apparatus and method for supplying uninterrupted flow of solid-ink pellets to an image-forming device. The apparatus includes a container for retaining solid-ink pellets, and a selectably-inflatable bladder disposed within the container. Further, the apparatus includes a tube communicating the bladder with a pressure supply.

11 Claims, 2 Drawing Sheets

METHOD AND APPARATUS FOR DELIVERING SOLID-INK PELLETS

CROSS-REFERENCE TO RELATED APPLICATION

This application is a divisional patent application of application Ser. No. 13/184598, now U.S. Pat. No. 8,727,517, filed Jul. 18, 2011, entitled "METHOD AND SYSTEM FOR DELIVERING SOLID-INK PELLETS," which application is incorporated herein in its entirety.

TECHNICAL FIELD

The presently disclosed embodiments relate to extraction of solid-ink pellets for imaging, and more particularly to devices that maintain flowability of solid-ink pellets during delivery.

BACKGROUND

An image-forming apparatus, such as a printer, a fax machine, or a photocopier, includes a system for extracting ink pellets from a container and delivering the extracted ink pellets to the image-forming apparatus. Conventionally, solid-ink or phase change ink printers receive ink in solid form, either as pellets or as ink sticks. A container stores the solid-ink pellets, which are extracted for print media production whenever required. A vacuum source pulls the solid-ink pellets from an extraction point in the container, using a vacuum tube.

Generally, when stored in the container over time or when transported, the solid-ink pellets tend to bridge or clump together. Bridging occurs close to the extraction point of the container due to pellets static charge, and this action impedes movement of the solid-ink pellets. Also, triboelectric charge between the pellets often creates a void proximate to the extraction point of the container. This is referred to as rat holing effect. The void and bridges obstruct consistent flow of solid-ink particles out of the container.

An existing solution manually agitates the pellet container to dislodge the pellets, breaking up the bridges and clumps. In general, the containers store large quantities of solid-ink pellets, and manually agitating the container may be cumbersome. Also, manual agitation depends upon the efficiency of the person agitating the pellets and it is possible that the person may not be able to dislodge all the pellets properly.

It would be highly desirable to have a simple and cost-effective system for maintaining the flowability of solid ink-pellets from a container, breaking up bridges and clumps.

SUMMARY

One embodiment of the present disclosure provides an apparatus for supplying uninterrupted flow of solid-ink pellets to an image-forming device. The apparatus includes a container for retaining a quantity of solid-ink pellets, and a selectably-inflatable bladder disposed within the container. Inflation of the bladder breaks up an agglomeration of solid-ink pellets. Further, the apparatus includes a tube communicating the bladder with a pressure supply.

Another embodiment discloses a method for supplying solid-ink pellets stored in a container to an image-forming device. The container includes one or more bladders positioned at selected locations within the container. The method includes moving the bladders between a collapsed state and an expanded state. The motion of the bladder displaces the solid-ink pellets in the container thereby breaking up agglomerates.

DETAILED DESCRIPTION

The following detailed description is made with reference to the figures. Preferred embodiments are described to illustrate the disclosure, not to limit its scope, which is defined by the claims. Those of ordinary skill in the art will recognize a number of equivalent variations in the description that follows.

Overview

The present disclosure describes various embodiments of a system and a method for delivering solid-ink pellets from a container, employing a delivery tube to deliver pellets to an image-forming device. As disclosed, the system provides a mechanism to avoid delivery failures and maintain pellet flowability. To this end, one or more pulsating bladders are placed inside the container to agitate the solid-ink pellets. The disturbances introduced within the container break up agglomerations of solid-ink pellets, and a suction force, applied to the delivery tube, provides a motive force to extract the pellets from the container.

As used herein, the following terms have the indicated definitions:

"Tube" includes any generally elongated hollow device suitable for conveying fluid or particulates. As thus defined, a tube may be formed of a suitable material, designed to accomplish results needed in a particular application.

"Solid-ink pellets" are liquefiable wax-based pellets, generally carrying a coloring agent, useful for forming images. Typically, an image-forming device melts the pellets before passing them to ink jets for printing. Typically, the diameter of the solid-ink pellets may be about 0.43 mm-1.3 mm. In some situations, the solid-ink pellets may range up to a maximum of about 3 mm in size.

An "agitator" is any device that applies force to solid ink pellets to break up agglomerations or clumps of pellets.

Conventional Delivery System

Figure 1:
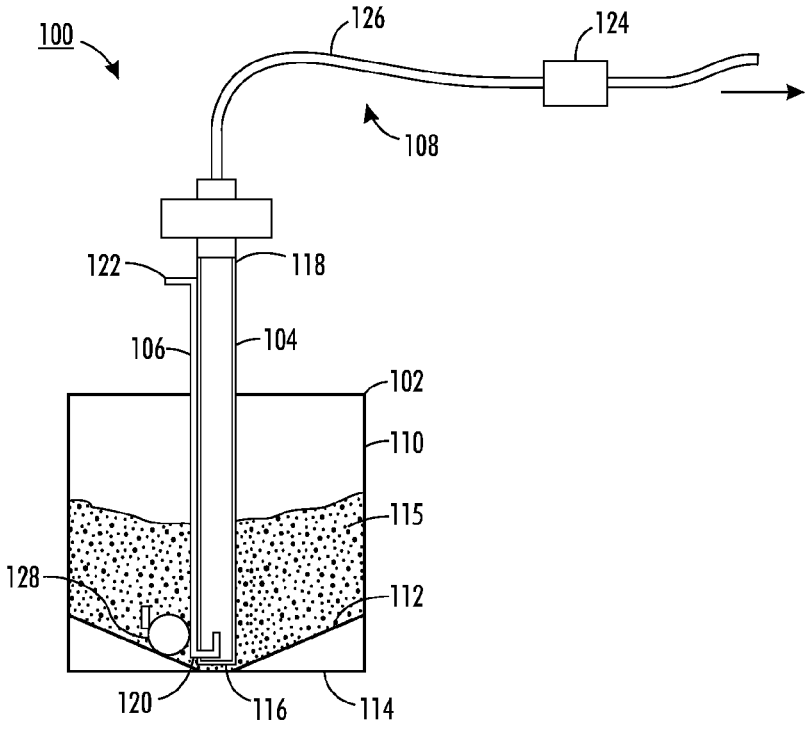
FIG. 1 illustrates a conventional delivery system in which a solid-ink pellet delivery system can operate.

FIG. 1 is a cross-sectional view illustrating a conventional delivery system 100 for supplying ink pellets to an image-forming device (not shown). The delivery system 100 includes a container 102 disposed with a delivery tube 104, and an assist tube 106. Further, the delivery tube 104 is connected to an extraction assembly 108.

The container 102 is a generally cylindrical receptacle, with vertical sidewalls 110 and a feeder bottom 112. The container bottom 114 is generally flat, to provide stability for the container 102, while the feeder bottom 112 extends from the container sidewall 110 at a position above the container bottom 114 and slopes downward and inward toward the center of the container 102. Thus, taken as a whole, feeder bottom 112 generally describes an inverted cone. In an embodiment, the tip of the conical feeder bottom 114 may be substantially flat. The top of the container 102 can remain open, or it can be closed, either by a detachable or a fixed lid (neither type of lid shown). The closed top includes inlet holes for positioning other elements within the container 102. In addition, the feeder bottom 112 may be permanently connected to the container 102 or may be an insert to the container bottom 114, as desired. In an embodiment, the container 102 may only include the flat bottom 114.

The container 102 is adapted to receive and store solid-ink pellets 115. Typically, container 102 is generally cylindrical and sized to store about 30 to 40 gallons of solid-ink pellets. The inverted cone shape of the feeder bottom 112 allows the solid-ink pellets 115 to flow towards the bottom of the container 102 under the force of gravity. The feeder bottom 112 is designed to promote downward flow, and thus the slope of that bottom is determined by a trade-off between flow rate, which increases with the slope, and desired volume, which decreases as slope increases. In an embodiment, feeder bottom 112 may lie at a downward slope of approximately 30 degrees. Container 102, along with the lid, if any, can be formed from convenient materials, such as plastic, wood or metal.

The delivery tube 104 provides a path by which solid-ink pellets 115 can flow from the container 102. Delivery tube 104 is generally rigid and tubular, having an input end 116, an output end 118, and a number of inlet holes (not shown). The inlet holes pass through the sides of the delivery tube 104 in the vicinity of the input end 116, providing a region from which the solid-ink pellets 115 are extracted from the container 102 and fed through the delivery tube 104. To accomplish this task, the output end 118 of the delivery tube 104 is connected to the extraction assembly 108, discussed below.

The delivery tube 104 stands vertically in container 102, with the input end 116 positioned on the bottom most portion of the inverted cone formed by bottom 112. The tube's output end 118 extending out from the container 102. The input end 116 may be attached to the container 102 permanently, or it may be positioned in the container 102 whenever solid-ink pellet extraction is required. In one embodiment, the substantially flat bottom end of the feeder bottom 112 may support the delivery tube 104. Alternatively, the delivery tube 104 may be supported by an opening formed in a lid or cover (not shown) provided atop the container 102. This entire delivery tube structure may be formed from any suitable material, such as Polyvinyl chloride.

In addition, sizing of the delivery tube 104 and its inlet holes can be tailored to the properties of the solid-ink pellets 115. For example, the diameter of the delivery tube 104 may be based on the size range of the solid-ink pellets being extracted. In an embodiment of the present disclosure, the inner diameter of the delivery tube 104 may be approximately ⅝ inch (15.875 mm).

The assist tube 106, having an input section 120 and an output section 122, is adapted to introduce airflow into the container 102. As shown, the assist tube 106 is a hollow tubular structure that stands vertically within the container 102, positioned adjacent the delivery tube 104. Assist tube 106 is bent at the bottom end such that the input section 120 is introduced into the delivery tube 104. Output section 122 extends out from the container 102 and may be connected to a source of airflow. The entire structure may be supported either by a convenient structure (not shown), such as struts, extending to the sides of container 102, or it may be attached to an opening formed in a lid or cover (not shown) provided atop the container 102, or it may be attached to the outer surface of the delivery tube 104.

Extraction assembly 108 provides both the motive means and the destination for the flow of solid-ink pellets 115. Components of extraction assembly 108 include a vacuum source 124 and a vacuum tube 126. Vacuum source 124 provides suction, using means such as an air suction pump, connected to the output end 118 of delivery tube 104 via vacuum tube 126. A similar tube extends from vacuum source 124 to a conventional input component of imaging devices, such as a melter.

In operation, vacuum source 124 applies suction to delivery tube 104, and the assist tube 106 introduces airflow to fluidize the flow of solid-ink pellets 115. The suction force pulls the solid-ink pellets 115 from the input end 116, impelling individual pellets to pass through inlet holes, become entrained in the airflow induced by assist tube 106, and traverse the delivery tube 104 en route to the image-forming device.

Alternatives and variations of the described structure will be apparent to those of skill in the art. On the macro scale, it will be recognized that the principles of the present disclosure apply generally to systems in which palletized solids or particulates must be delivered from one point to another. Similarly, the material, construction, and sizing of disclosed components may be varied as desired to see particular applications.

This system encounters difficulties as solid-ink pellets 115 agglomerates when stored in container 102 over time or during the pellet formation process. Then, pellet agglomerates (also referred to as clumps, arches, or bridges) cannot pass through inlet holes of the delivery tube 104. Further, these agglomerates result in voids within the container 102, exemplified by a void 128. Voids may also be formed by static attraction between solid-ink pellets 115. Experience has shown that these voids obstruct the flow of pellets from the container and most likely void creation point is the vicinity of the inlet holes.

Exemplary Embodiments

Figure 2:
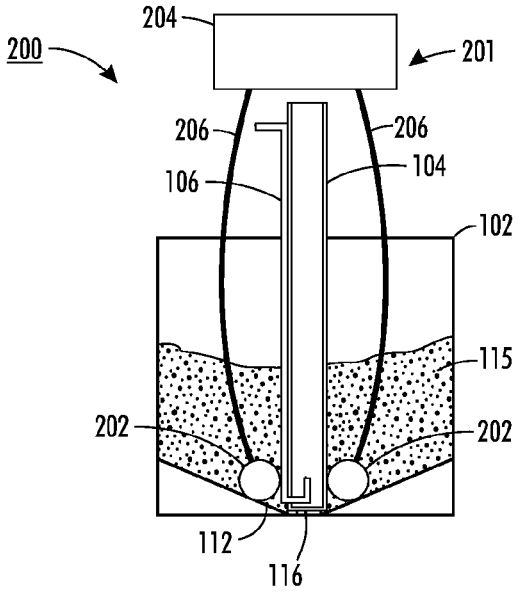
FIG. 2 illustrates an exemplary embodiment of an agitation assembly, operating in the exemplary environment of FIG. 1.

FIG. 2 schematically illustrates an exemplary system 200 for delivering an uninterrupted flow of solid-ink pellets 115 to an image-forming device (not shown) in accordance with the present disclosure. The system 200 employs a number of components identical to those discussed in connection with FIG. 1, such as assist tube 106, delivery tube 104, and vacuum source 124, which operate in similar fashion here and thus require no further elaboration. In addition, the system 200 includes an agitation assembly 201 for agitating solid-ink pellets 115.

The agitation assembly 201 includes one or more bladders, such as bladders 202, and actuator 204. Here, in contrast to systems known in the art, agitation assembly 201 does not break up agglomerations by striking them with a moving agitator device. Rather, an inflatable structure is located within the chamber, adapted to pulsate between inflated and non-inflated states, that pulsation providing sufficient agitation to break up pellet agglomerations. Several configurations of the inflatable structure are disclosed.

In the embodiment illustrated in FIG. 2, agitation is provided by inflatable bladders 202. As shown, two bladders 202 are employed, positioned on the inclined surface of the feeder bottom 112, on opposite sides of the delivery tube 104. The number, size, and position of bladders 202 can be selected by those of skill in the art, depending upon the particular application at hand. A spherical shape has proved useful, formed from a suitable flexible material, such as rubber.

Each bladder 202 is adapted to expand and collapse. That action occurs through the introduction of a compressed gas, fed from a compressor (not shown) contained within actuator 204, through tubes 206 to each bladder 202. As the bladder 202 expands, it causes the pellets to move, also providing agitation to break up agglomerations. Then, gravity can impel ink pellets downward toward input end, maintaining flowability of the solid-ink pellets 115. As can be understood by those of skill in the art, actuator 204 could be contained completely within the image forming device served by the embodiments of the present disclosure.

Bladder inflation and deflation is completely selectable. These actions may occur at a set frequency, after selected periods, or under manual control. Continuous inflation and deflation ensures that agglomerations are rapidly broken, maintaining the flowability of the pellets. Alternatively, actuator 204 could be set to perform pulsation only at a relatively long intervals. That situation would be effective if agglomerations were relatively rare within the solid-ink pellets. In a situation where agglomerations were exceedingly rare, pulsation could be completely under operator control. If desired, those of skill in the art could provide control means, measuring a variable such as pellet flow rate within delivery tube 104, triggering pulsation when flow rate fell below a selected value. Together with any of these control schemes, pulsation could be initiated at to occur in connection with specific events, such as before starting the imaging process, once a day or at predetermined time intervals, or as preferred.

Further, the flow profile of air into the bladders 202 could be controlled to provide specific pulsation characteristics. A rapid inflation/deflation cycle would have maximum mechanical impact on the pellets, for example. Alternatively, a more complex cycle could be programmed, in which the first inflation/deflation cycle only inflated the bladder 202 half its maximum diameter, followed by cycles in which the inflation progressively increased to a maximum bladder size. Use of the cycles is well within the skill of those in the art, who can assess the likelihood in nature of agglomerations present in particular applications and can judge the effect on such agglomerations of specific inflation/deflation profiles.

Moreover, the size and shape of the bladders 202 can be varied to fit particular applications. The spherical shape shown in FIG. 2 is inherently flexible and makes the best use of material and pressure, but other configurations could be useful as well. It could be desired, for example, that the bladder may expand more in one direction than in others. In that manner, for example, a profile in which the bladder extends in a relatively large extent upwards, a relatively slighter extent sideways, and virtually none at all downward could be obtained by forming the bladder 202 out of different materials having differing stretch characteristics. Similarly, position of the bladders, of whatever shape, can be varied within the container. Bladders 202 may be placed at the bottom of the container, around the sidewalls 110, or along the height of the container 102. These and other alterations are well within the skill of those in the art.

In use, the bladders 202 are positioned at a desired portion with the container and actuator 204 pumps air into and out of each bladder, expanding and compressing them in alternation. This movement of each bladder 202 displaces the solid-ink pellets 115, and pushes pellets toward the input end of the delivery tube 104. Subsequently, a combination of suction force induced by the extraction assembly 108 and the airflow introduced by the assist tube 106 extracts the agitated solid-ink pellets 115 through the delivery tube 104. Finally, the extraction assembly 108 passes the pellets to a component of an image-forming apparatus.

Figure 3A:
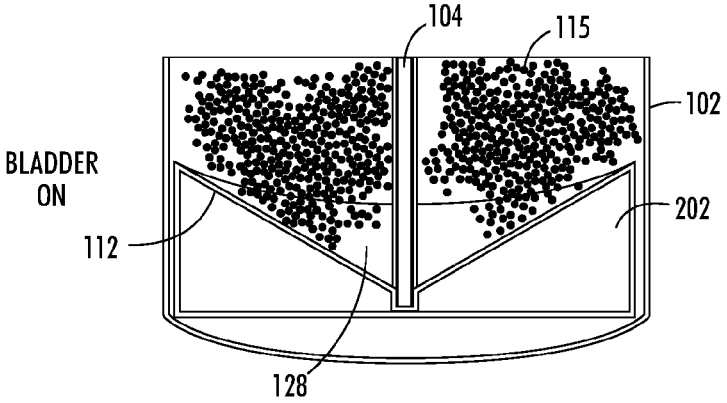
FIGS. 3A, 3B, and 3C illustrate an alternate embodiment of the agitation assembly of the present disclosure.
Figure 3B:
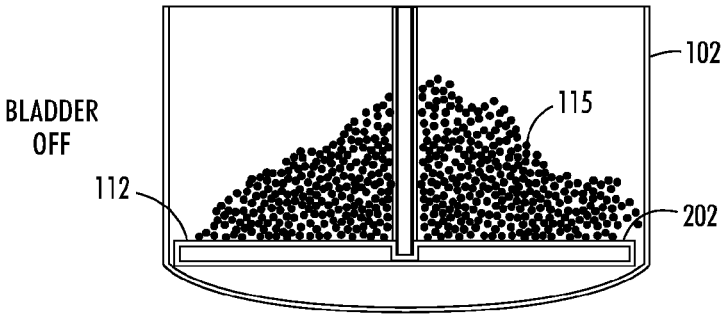
Figure 3C:
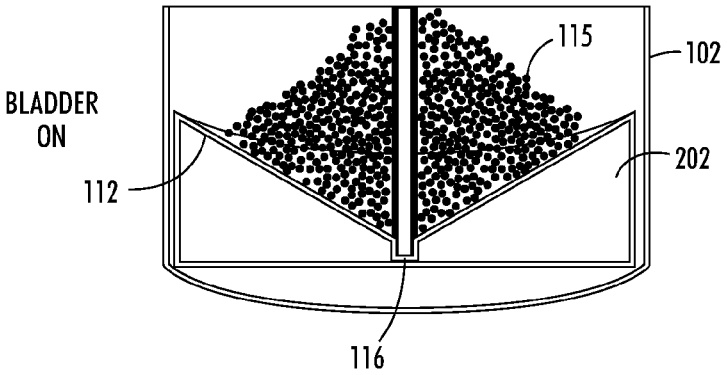

FIGS. 3A, 3B, and 3C illustrate an alternate embodiment of the agitating assembly 201, where a single agitator such as the bladder 202 is employed. The present embodiment differs from the structure defined in FIG. 1 by modifying the shape and position of the bladder 202, so that the inflation and deflation of the bladder 202 completely changes the shape of the bottom surface of the container. Here, bladder 202 is positioned beneath the feeder bottom 112 within the space created by the walls of the container 102 and the feeder bottom underside. Because bladder 202 is a flexible device, it may completely or partially fill this space. Moreover, the feeder bottom may be flexibly attached to the container such that only the tip of the concavity is connected to the container, the remainder of the structure being supported by the bladder 202. Alternatively, the container 102 includes no feeder bottom and inverted conical shaped bladder 202 is placed on the bottom 114. The starting position for this embodiment is shown in FIG. 3A, where bladder 202 is in the shape of an inverted cone. It should be noted that pellets 115 have formed a number of agglomerations, and those agglomerations cannot smoothly flow to the input of the delivery tube 104, and thus void 128 around that input point results. In this state, bladder 202 is in a pressurized condition.

When actuator 204 pumps compressed gas out of the bladder 202, the bladder collapses from the inverted cone to the flat surface, shown in FIG. 3B. That movement causes the stack of solid-ink pellets 115 to collapse, a movement that results in breaking up agglomerations and filling the void 128.

Then, as shown in FIG. 3C, bladder 202 is re-inflated to form a conical concavity. That movement further serves to break up any agglomerations, and it also urges individual pellets toward the middle of the container 102, to the vicinity of the input end 116. This embodiment offers the advantage of providing a rather considerable, complex movement pattern. As a result, superior results for breaking up agglomerations should be expected.

This embodiment illustrates the wide possibilities for employing the present disclosure. Those of skill in the art can analyze the problems occurring in a specific application and can determine the amount, frequency, and direction of agitation most likely to solve that problem, and then an appropriate bladder, or combination of bladders, can be designed and positioned, together with an appropriate inflation/deflation profile, to solve that problem. A considerable range of possible solutions is available to the designer, all within the scope of the present disclosure.

It should be noted that the description below does not set out specific details of manufacture or design of the various components. Those of skill in the art are familiar with such details, and unless departures from those techniques are set out, techniques, designs and materials known in the art should be employed. Those in the art are capable of choosing suitable manufacturing and design details.

The terminology used herein is for the purpose of describing particular embodiments only and is not intended to be limiting of the disclosure. It will be appreciated that several of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. An apparatus for supplying uninterrupted flow of solid-ink pellets to an image-forming device, the apparatus comprising a container for retaining a quantity of solid-ink pellets; and a selectably-inflatable bladder disposed in the container, whereby inflation of the bladder changes a shape of a bottom interior surface of the container.

2. The apparatus of claim 1, wherein the bladder is placed at the bottom interior surface of the container.

3. The apparatus of claim 1, wherein the bladder, when inflated, forms at least a portion of a substantially conical concavity.

4. The apparatus of claim 1 further comprising a delivery tube extending into the container for extracting ink pellets from the container.

5. The apparatus of claim 4, wherein the delivery tube is connected to an extraction assembly for extracting solid-ink pellets from the container through the delivery tube.

6. The apparatus of claim 4, wherein an end of the delivery tube is substantially disposed near an apex of the concavity.

7. A method for supplying solid-ink pellets stored in a container, the method comprising:

providing a selectively-inflatable bladders positioned at selected locations within the container; and moving the bladders between a collapsed state and an expanded state, wherein the motion of the bladder displaces the solid-ink pellets in the container.

8. The method of claim 7, wherein the expanded state is achieved by inflating the bladder.

9. The method of claim 7, wherein the collapsed state is achieved by collapsing the bladder.

10. The method of claim 7 further comprising step of extracting the agitated solid-ink pellets.

11. The method of claim 7, wherein the extracting step includes providing airflow to transport the solid-ink pellets.

* * * * *